United States Patent [19]

Kayata

[11] Patent Number: 5,034,755

[45] Date of Patent: Jul. 23, 1991

[54] THERMOELECTRIC PRINTER WITH ELECTRODE DISPOSED IN RIBBON CARTRIDGE

[75] Inventor: Haruhiko Kayata, Oume, Japan

[73] Assignee: Kabushiki Kaisha Toshiba, Kawasaki, Japan

[21] Appl. No.: 442,775

[22] Filed: Nov. 29, 1989

[30] Foreign Application Priority Data

Nov. 29, 1988 [JP] Japan ..... 63-154228[U]
Nov. 29, 1988 [JP] Japan ..... 63-154230[U]

[51] Int. Cl.[5] ..... G01D 5/10; B41J 2/39
[52] U.S. Cl. ..... 346/76 PH; 400/120
[58] Field of Search ..... 346/76 PH, 139 C; 400/120

[56] References Cited

U.S. PATENT DOCUMENTS 4,329,071 5/1982 Applegate et al. ..... 346/76 PH
4,420,758 12/1983 Tabata et al. ..... 346/76 PH
4,855,758 8/1989 Kuwabara et al. ..... 400/120
4,897,668 1/1990 Nagato et al. ..... 400/120

FOREIGN PATENT DOCUMENTS 0008276 1/1981 Japan ..... 400/120
0147358 8/1985 Japan ..... 400/120

*Primary Examiner*—Benjamin R. Fuller
*Assistant Examiner*—Huan Tran
*Attorney, Agent, or Firm*—Foley & Lardner

[57] ABSTRACT

A thermoelectric printer includes a cartridge accommodating a pair of reels around which a thermoelectric ink ribbon is wound, a carriage for removably supporting the cartridge, a printing head disposed on the carriage to apply a recording voltage to the ink ribbon to carry out printing, and a return electrode disposed inside the cartridge to electrically contact the ink ribbon. A resilient member conductive to the return electrode is also arranged inside the cartridge. The carriage has a contact element. When the cartridge is installed to the carriage, the contact element protrudes inside the cartridge to forcibly-contact the resilient member to form an electric correction between them. Then, a printing current flows from a recording electrode of the printing head to the ink ribbon, return electrode, resilient member and contact element and is then discharged to the carriage.

6 Claims, 9 Drawing Sheets

THERMOELECTRIC PRINTER WITH ELECTRODE DISPOSED IN RIBBON CARTRIDGE

BACKGROUND OF THE INVENTION

1. Field of the Invention

The present invention relates to a thermoelectric printer that applies a voltage to part of a ink ribbon to heat the part and transfer ink from the ribbon to a printing sheet. Particularly, the present invention relates to a thermoelectric printer, with an ink ribbon cartridge that is easily installed in and removed from the printer.

2. Description of the Prior Art

A thermoelectric ink ribbon employed for a thermoelectric printer generally comprises a resistive layer formed of a base film having proper electric resistance, a conductive layer made of an electrical conductor, such as aluminum, deposited on one side of the resistive layer, and an ink layer made of solid or semi-solid ink applied on the conductive layer. A printing head of the printer has many thin pins serving as recording electrodes. The pins are selected according to printing patterns and pressed against part of the resistive layer of the ink ribbon so that a recording voltage is applied to the resistive layer. Then, a recording current flows to the conductive layer through the resistive layer of the ink ribbon to generate Joule's heat in the resistive layer. The heat melts the ink layer of the ink ribbon to print the printing patterns on a printing sheet.

The recording current applied to the conductive layer is grounded through a return electrode contacting the ink ribbon.

The ink ribbon is generally received in a resin cartridge to be installed in a cartridge type thermoelectric printer.

According to the cartridge type thermoelectric printer, the cartridge supports a pair of reels around which the ink ribbon is wound and taken up from one to the other. The cartridge is removably installed in a carriage of the printer.

The carriage is guided by a carriage shaft and a rail arranged in parallel with each other. A motor drives a transmission belt that provides the carriage with a recording motion in a recording direction and a returning motion in the opposite direction. Behind the carriage, a platen runs parallel with the carriage shaft. In front of the platen, a printing sheet is set.

The carriage is provided with printing head means. The printing head means comprises an arm supported by a pin such that the arm can move toward the printing sheet, and a printing head fitted to the free end of the arm. While the carriage is in the recording motion, the arm is driven by an actuator to move the printing head toward the printing sheet. Then, the ink ribbon located between the printing head, and the printing sheet is moved to an ink transferring position adjacent to the printing sheet.

The carriage is provided with a return electrode made of a roller, for discharging a recording current flowing through the ink ribbon. The return electrode is arranged in the vicinity of the resistive layer of the ink ribbon when the cartridge is installed to the carriage. The return electrode faces a pinch roller with the ink ribbon between them. The pinch roller is pushed against the return electrode. By manually operating a control lever, the pinch roller is removed from the return electrode and held at the removed position through an interlocking mechanism provided for the carriage.

The conventional cartridge type thermoelectric printer mentioned in the above has a drawback that it requires installing and removing the cartridge in and from the carriage is troublesome.

Namely, to install the cartridge in the carriage, the control lever of the pinch roller is operated to separate the pinch roller from the return electrode. Then, the cartridge is installed in the carriage, and the ink ribbon is inserted between the pinch roller and the return electrode. The control lever is released to press the pinch roller against the return electrode such that the return electrode and the ink ribbon contact with each other.

To remove the cartridge from the carriage, the control lever is operated to separate the pinch roller from the return electrode. Then, the cartridge is removed from the carriage.

SUMMARY OF THE INVENTION

An object of the present invention is in provide a thermoelectric printer with an ink ribbon cartridge that is easily installed to and removed from the printer.

Another object of the present invention is in provide a thermoelectric printer with a simple mechanism for installing and removing an ink ribbon cartridge to and from the printer.

In order to accomplish these objectives, the present invention provides a thermoelectric printer comprising a cartridge accommodating a pair of reels around which a thermoelectric ink ribbon is wound, a carriage for supporting the cartridge, printing head means disposed on the carriage to apply a recording voltage to the ink ribbon to carry out printing, and a return electrode contacting with the ink ribbon and being conductive to the ink ribbon that is conductive to a recording electrode disposed on the printing head means. The return electrode and a resilient member conductive to the return electrode are arranged with a contact element. When the cartridge is installed to the carriage, the contact element protrudes inside the cartridge to forcibly contact the resilient member and form an electric contact between them.

With this arrangement, the return electrode is disposed in the cartridge so that the return electrode and the ink ribbon may contact with each other in advance in the cartridge. Only by installing the cartridge to the carriage, the contact element of the carriage protrudes inside the cartridge to contact the resilient member that is conductive to the return electrode. As a result, the return electrode of the cartridge and the contact element of the carriage become conductive to each other, to discharge a current to the carriage.

According to another aspect of the present invention, a thermoelectric printer comprises a cartridge incorporating a pair of reels around which a thermoelectric ink ribbon is wound, a carriage for supporting the cartridge, printing head means disposed on the carriage to apply a recording voltage to the ink ribbon to carry out printing, and a return electrode conductive to the ink ribbon. The return electrode is disposed in the cartridge, and part of the return electrode is exposed outside the cartridge. The carriage is provided with a contact element that contacts with the exposed part of the return electrode to form an electric connection between them the cartridge is installed in the carriage.

With this arrangement, the return electrode is disposed in the cartridge so that the return electrode and the ink ribbon may contact with each other in advance in the cartridge. When the cartridge is installed to the carriage, the contact element of the carriage contacts the exposed part of the return electrode to form electrical connection between them to discharge a recording current to the carriage.

These and other objects, features and advantages of the present invention will be more apparent from the following detailed description of preferred embodiments in conjunction with the accompanying drawings.

DETAILED DESCRIPTION OF THE EMBODIMENTS

Figure 1:
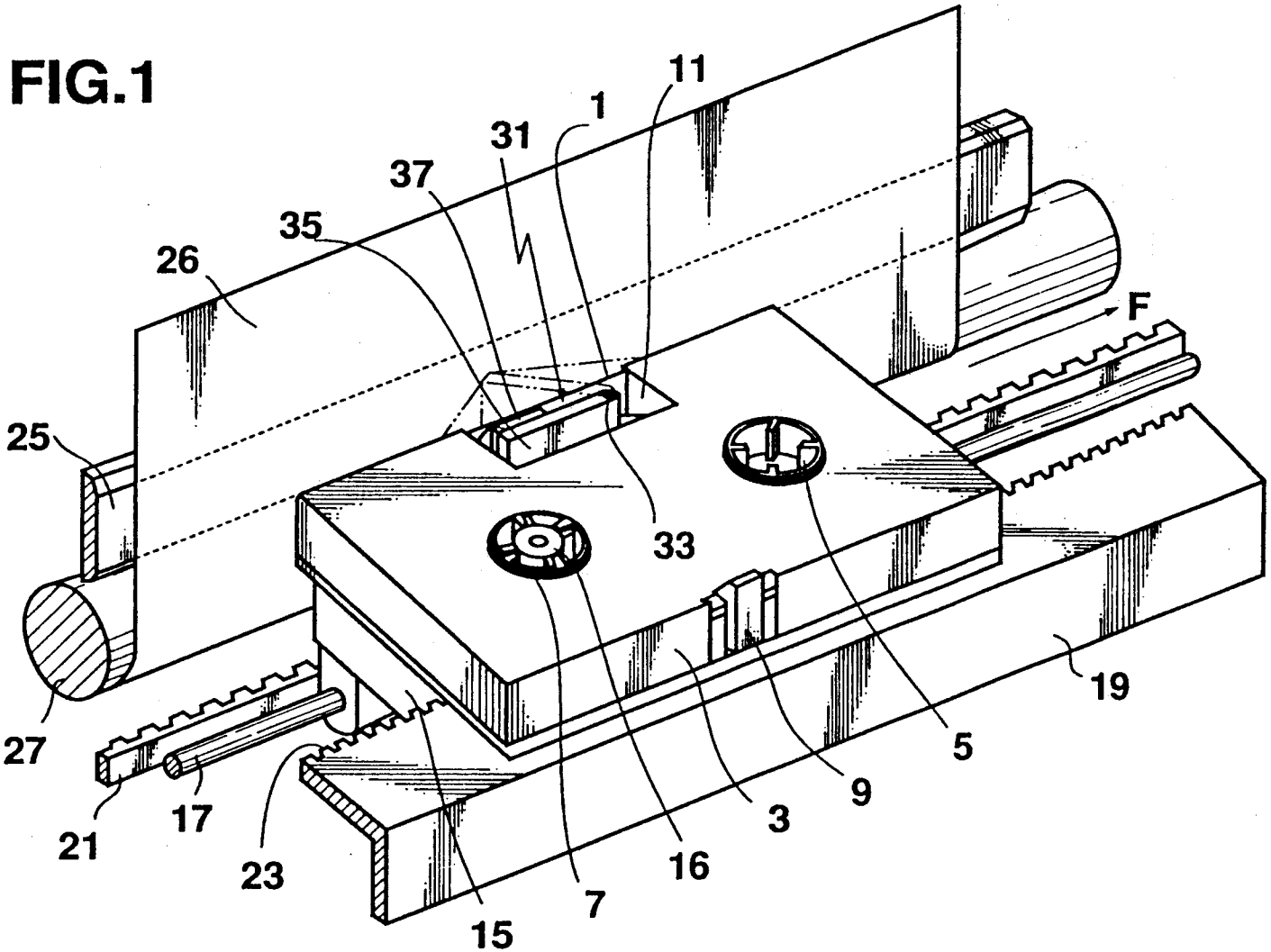
FIG. 1 is a perspective view showing the essential parts of a thermoelectric printer according to a first embodiment of the present invention.

With reference to FIG. 1 the essential arrangement of a thermoelectric printer according to the first embodiment of the present invention will be explained.

An ink ribbon 1 is wound around a pair of reels 5 and 7 supported inside a resin cartridge 3. The ink ribbon 1 is taken up from reel 5 by reel 7. The cartridge 3 is removably attached to a carriage 15 by means of a hook 9.

The carriage 15 is guided by a carriage shaft 17 and a rail 19 of angle shape that are arranged in parallel with each other. A motor (not shown) drives a transmission belt 21 in normal and reverse directions. Pulled by the transmission belt 21, the carriage 15 performs a recording motion in a recording direction F and a returning motion in a direction opposite to F. Behind the carriage 15, a platen 25 is arranged in parallel with the carriage shaft 17. In front of the platen 25, a printing sheet 26 is set. The sheet 26 is intermittently fed upward by a rubber roller 27.

The carriage 15 is provided with printing head means 31. The printing head means 31 comprises an arm 35 supported by a pin 33 such that the arm 35 can move horizontally, and a printing head 37 attached to a free end of the arm 35. While the carriage 15 is in recording motion, the printing head means 31 is driven by an actuator (not shown) to turn from a standby position indicated with a continuous line to an operating position indicated with an imaginary line. As a result, the ink ribbon 1 is brought to an ink transferring position adjacent to the printing sheet 26.

The gist of the present invention is to eliminate the control lever needed by the conventional thermoelectric printer in installing and removing a cartridge in the printer. The details of the invention will be explained.

Figure 2:
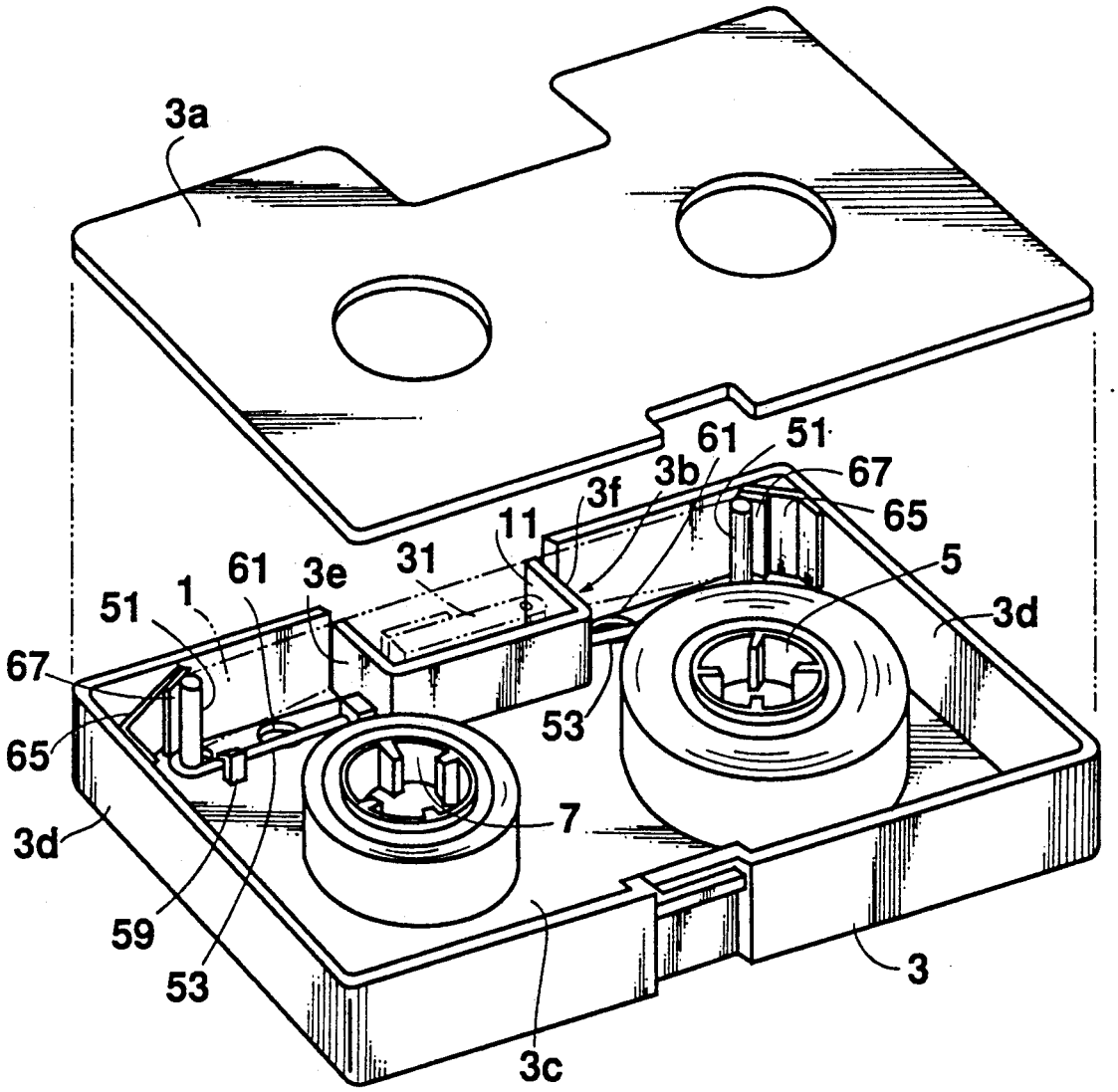
FIG. 2 is an exploded perspective view showing a part of a cartridge of the printer of FIG. 1.

FIG. 2 shows the inside of the cartridge 3 with the case cover **3*a* removed. A head receiving portion 11 is defined by a partition wall 3*b* of channel shape. The back of the head receiving portion 11 is open to accommodate the printing head means 31. The ink ribbon 1 from the reel 5 passes behind the partition wall 3*b* and is taken up by the reel 7. A bottom plate 3*c* of the cartridge 3 is provided with a return electrode 51** of columnar shape according to this embodiment.

A pair of the return electrodes 51 are disposed in a running path of the ink ribbon 1 extending between the partition wall **3*b* and the reels 5 and 7. In this running path, bases of the return electrodes 51 are embedded in the bottom plate 3*c* at positions where the return electrodes 51 contact with a resistive layer of the ink ribbon 1 irrespective of the diameters of windings of the ink ribbon 1 around reels 5 and 7**.

Figure 3:
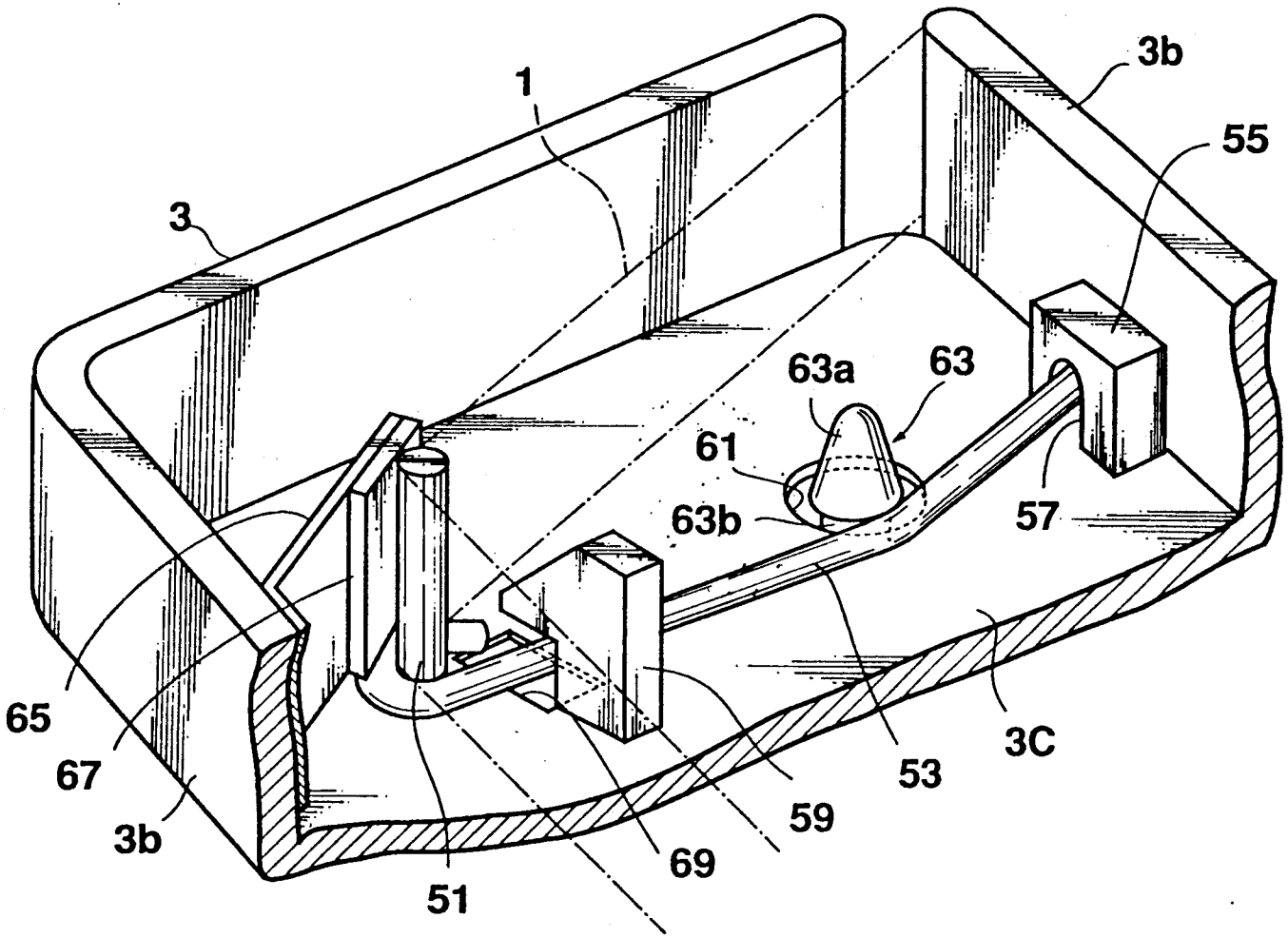
FIG. 3 is an enlarged perspective view showing the essential parts of the cartridge installed in a carriage of the printer.

Linear spring members 53 made of conductive material are disposed on the bottom plate **3*c*. One end of each spring member 53 is connected to corresponding one of the return electrodes 51 while the other end thereof reaches the partition wall 3*b*. As shown in FIG. 3 in detail, one end of the spring member 53 is bent over to engage a base of the return electrode 51, while the other end thereof engages a hole 57 formed in a boss 55. The boss 55 is formed on each of side walls 3*e* and 3*f* of the partition wall 3*b*. A stopper projection 59 is formed upright on the bottom plate 3*c* in the vicinity of each return electrode 51 and spring member 53. The projection 59 prevents the spring member 53 from separating from the return electrode 51**.

Nearly at the center of each of the spring members 53, a through hole 61 is formed through the bottom plate **3*c*. The through hole 61 is formed on one side of the spring member 53 (in the figure, on the other side of the spring member 53 with respect to the reel 5 or 7). The carriage 15 is provided with contact elements 63. When the cartridge 3 is installed to the carriage 15, the contact elements 63 pass through the through holes 61 and bend the spring members 53, respectively. Each of the contact elements 63 comprises a conical portion 63*a* formed at a front end of the contact element 63, and a cylindrical portion 63*b* whose diameter is smaller than that of the bottom of the conical portion 63*a*. The length of the cylindrical portion 63*b* is set such that the cylindrical portion protrudes inside the cartridge 3 for a length substantially equal to the thickness of the spring member 53 when the cartridge 3 is installed to the carriage 15**.

As shown in FIGS. 2 and 3, a plate spring 65 is arranged such that the base thereof is fixed to each side wall **3*d* of the cartridge 3. A felt chip 67 is adhered to a free end of the plate spring 65 such that the ink ribbon 1 is resiliently held between the felt chip 67 and the return electrode 51. By this, the resistive layer of the ink ribbon 1 contacts with the return electrode 51, and this contacting state is satisfactorily maintained. The felt chip 67 provides good tightness while the ink ribbon 1 is running. The felt chip 67 may be substituted by a roller, etc. A conductive roller may slidably and rotatably fitted to the return electrode 51 to further reduce running resistance of the ink ribbon 1**.

Figure 5:
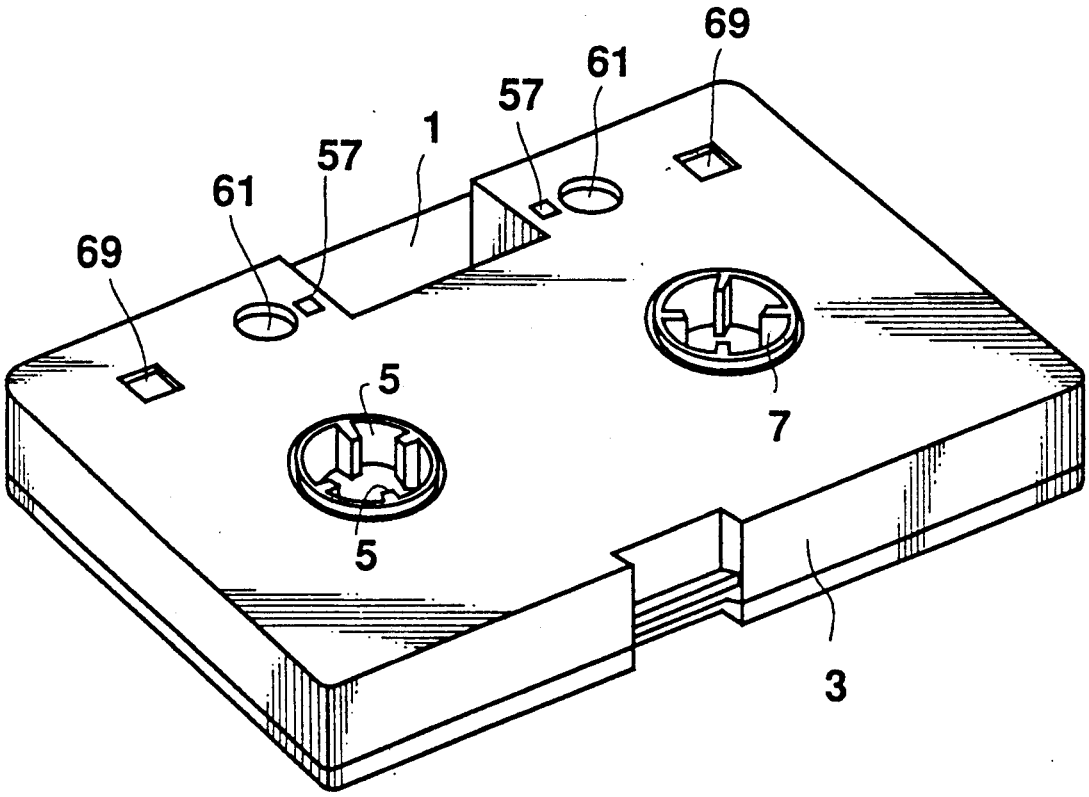
FIG. 5 is a perspective view showing the bottom of the cartridge.

FIG. 5 shows the reverse side of the cartridge 3. A recess 69 is formed for each stopper projection 59. The printing head means 31 is arranged on the carriage 15 in a known manner. The carriage 15 incorporates a gear mechanism engaging with a rack 23. During the recording motion in the direction F, the carriage 15 drives and rotates a winding cam 16 with which the reel 7 engages from the above.

Operation of the first embodiment will be explained.

Figure 4:
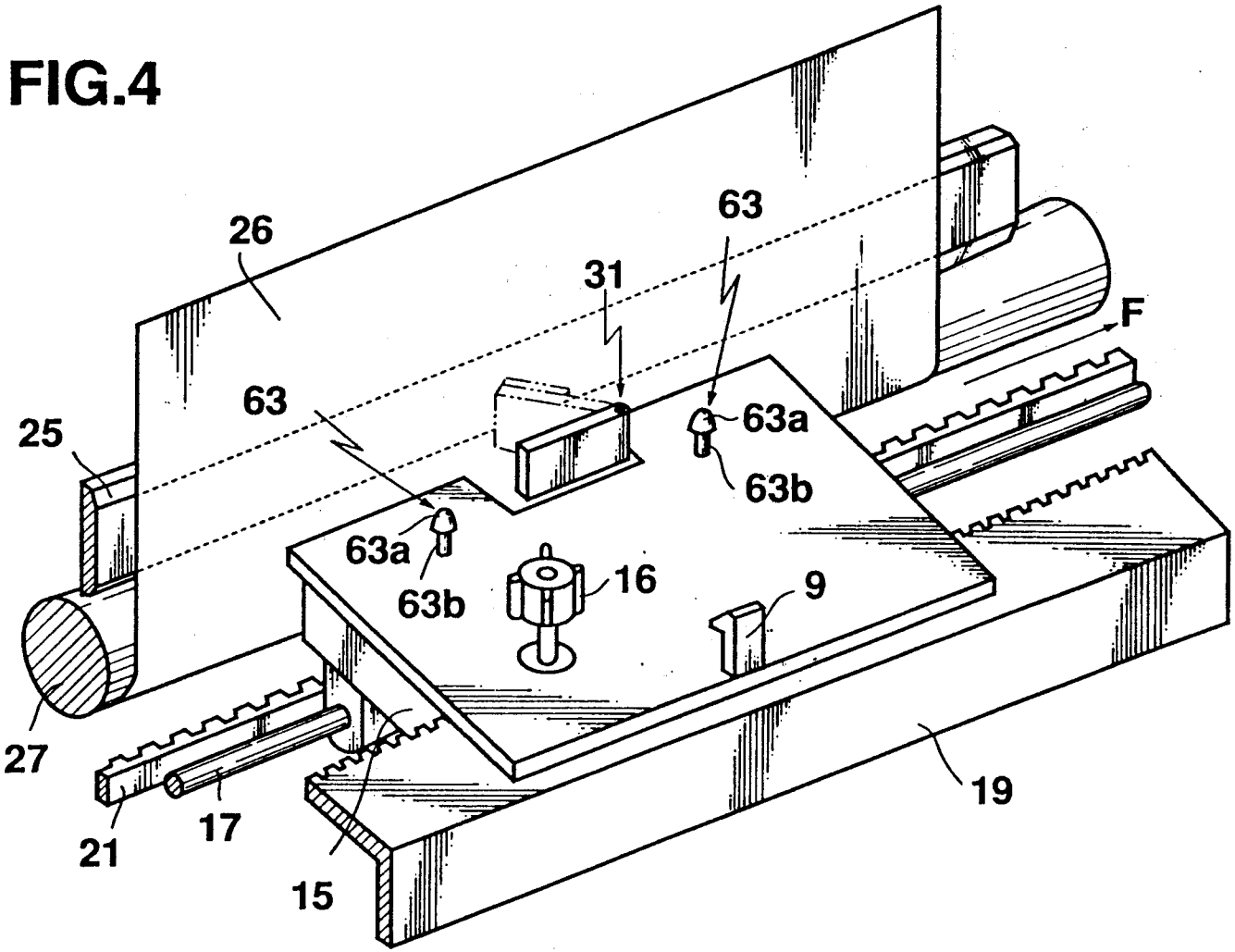
FIG. 4 is a perspective view mainly showing the carriage of the printer of FIG. 1.

In FIG. 4, the cartridge 3 is removed from the carriage 15. The printing head means 31 is in a standby position indicated with a continuous line. When the cartridge 3 is installed to the carriage 15 from the above, the printing head means 31 is received as it is in the head receiving portion 11 as shown in FIG. 1. At the same time, the winding cam 16 is inserted into the reel 7, and the contact elements 63 are inserted into the through holes 61 with the conical portions 63*a* bending the spring members 53. After that, the spring members 53 contact with the cylindrical portions 63*b* of the contact elements 63 so that the return electrodes 51 and contact elements 63 may be conductive to each other through the spring members 53. This installed state is maintained by the hook 9 that holds the back side of the cartridge 3. At this time, the bottoms of the cylindrical portions 63*b* more or less restrict upward movements of the spring members 53 to hold the front side of the cartridge 3 at its position. Therefore, holding means for the front side of the cartridge 3 may be omitted.

The return electrodes 51, cartridge 3 and ink ribbon 1 forms a unit that is independent of the carriage 15. Therefore, only by placing the cartridge 3 on the carriage 15, the unit may be installed to the carriage 15. And only by releasing the hook 9, the unit may be removed from the carriage 15. At this time, engagement between the spring members 53 and the contact elements 63 is not so strong so that the cartridge 3 may be pulled upward by releasing the hook 9 to easily remove the cartridge 3 from the carriage 15.

Once the cartridge 3 with return electrodes 51 is set on the carriage 15, the printer may repeat the recording and returning motions. During the recording motion, the printing head means 31 brings the ink ribbon 1 to the ink transferring position indicated with the imaginary line of FIG. 1 to perform printing in a known manner. At this time, a recording current flows from a recording electrode of the printing head 37 to the resistive layer then to conductive layer of the ink ribbon 1. After that, at positions of the return electrodes 51, the recording current passes through the resistive layer again, return electrodes 51, spring members 53 and contact elements 63 and is discharged to the carriage 15.

As shown in FIGS. 2 and 4, the first embodiment is provided with each pair of the return electrodes 51, spring members 53 and contact elements 63. This arrangement can increase the amount of currents flowing from the recording electrode of the printing head 37 to the ink ribbon 1, to improve an electricity collecting effect and a printing accuracy. Alternatively, only a single set of them may be acceptable. In place of the linear spring members 53, plate spring members may be employed and formed integrally with the return electrodes 51 respectively.

As described in the above, according to the first embodiment, return electrodes contacting an ink ribbon are disposed inside a cartridge incorporating the ink ribbon. As a result, a mechanical interlocking portion related to a carriage may be omitted to simplify a printer arrangement and reduce costs. The cartridge can quickly and easily be attached to and removed from the carriage.

With reference to FIGS. 6 to 10, a thermoelectric printer according to the second embodiment of the present invention will be explained.

Figure 6:
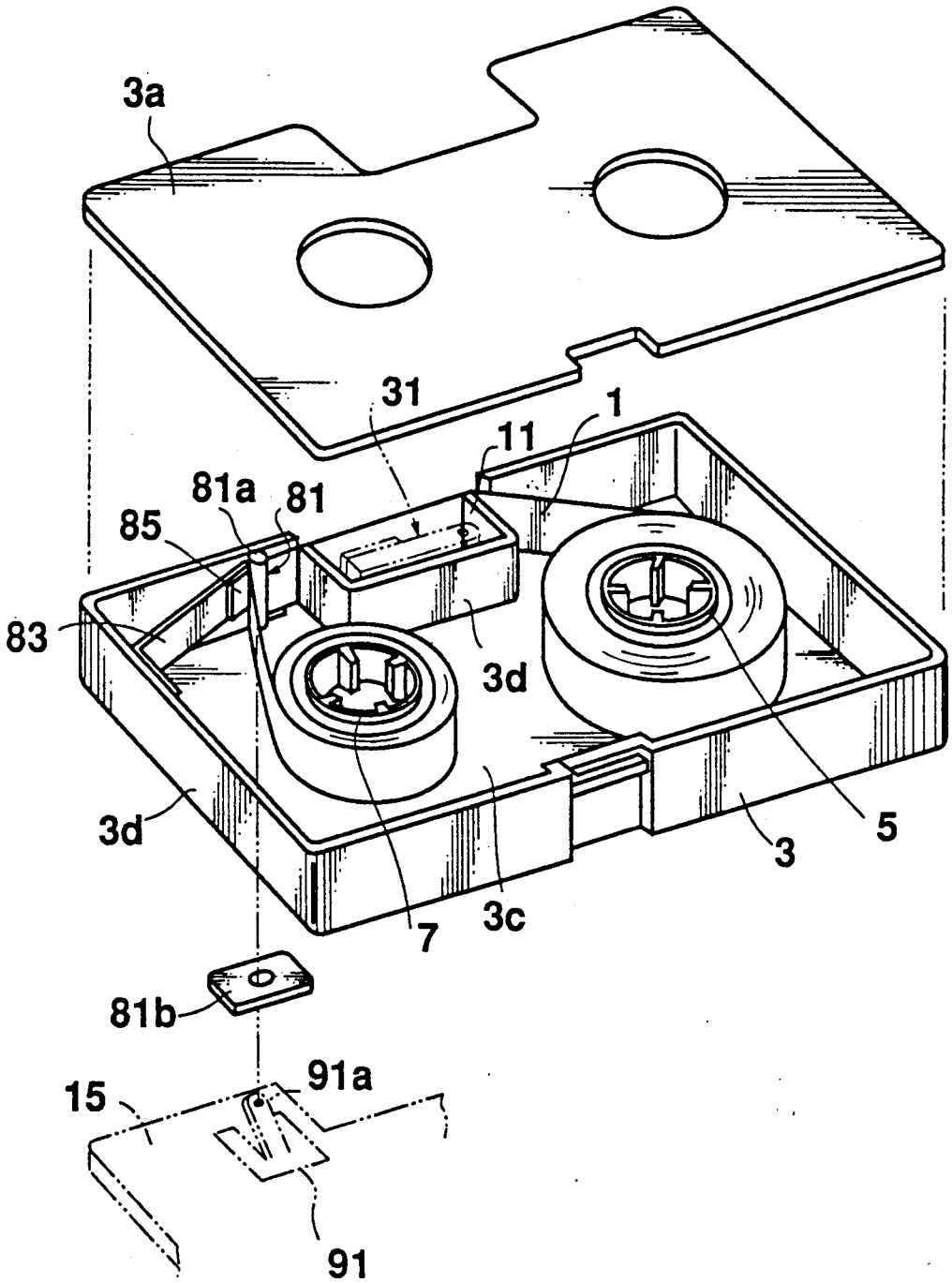
FIG. 6 is an exploded perspective view mainly showing a cartridge of a printer according to a second embodiment of the present invention.

FIG. 6 shows the inside of a cartridge 3 with a case cover 3*a* being removed. A head receiving portion 11 is defined by a partition wall 3*b* of channel shape and is open at its back to receive printing head means 31. An ink ribbon 1 is wound around a reel 5 and passes behind the partition wall 3*b* to be wound around a take-up reel 7. A bottom plate 3*c* of the cartridge 3 is provided with an upright return electrode 81 according to this embodiment.

The return electrode 81 comprises a bar-like electrode body 81*a* and a plate-like exposed portion 81*b*. The return electrode 81 is arranged in a running path of the ink ribbon 1 extending from the partition wall 3*b* to the take-up reel 7. A base of the electrode body 81*a* is embedded in the bottom plate 3*c* at a position where the electrode body 81*a* can contact with a resistive layer of the ink ribbon 1 irrespective of the diameter of a winding of the ink ribbon 1 around the reel 7.

Figure 10:
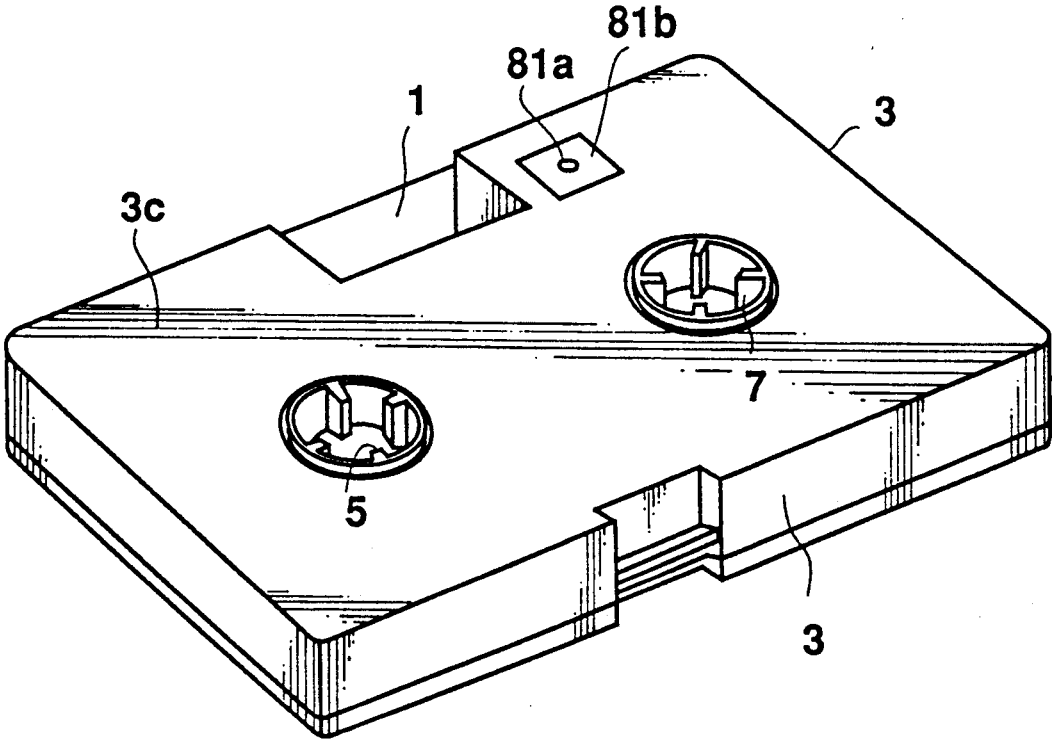
FIG. 10 is a perspective view showing the bottom of the cartridge.

As shown in FIG. 10, the exposed portion 81*b* is fixed to a lower face of the bottom plate 3*c* of the cartridge 3, and a lower end of the electrode body 81*a* is tightly fitted to the exposed portion 81*b* such that they are electrically connected to each other.

Figure 9:
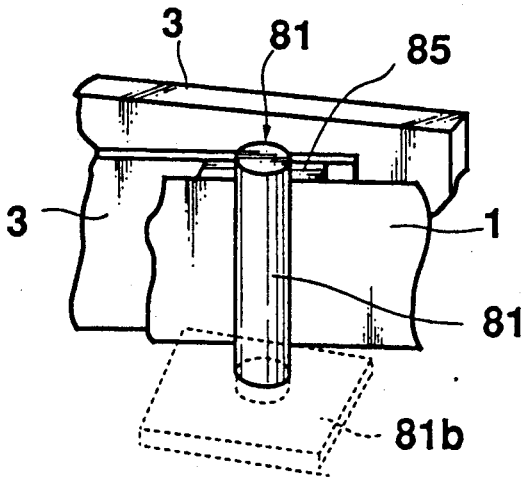
FIG. 9 is an enlarged explanatory view showing the essential parts of FIG. 6.

As shown in FIG. 6, the base of a plate spring 83 is fixed to one side wall 3*d* of the cartridge 3, and a felt chip 85 is adhered to a free end of the plate spring 83 such that the ink ribbon 1 is resiliently held between the felt chip 85 and the electrode body 81*a*, as shown in FIG. 9. As a result, the resistive layer of the ink ribbon 1 contacts with the electrode body 81*a*, and this contacting state is satisfactorily maintained. The felt chip 85 is properly pressed against the ink ribbon 1 while the ink ribbon is running. The felt chip 85 may be replaced by a roller.

Figure 7:
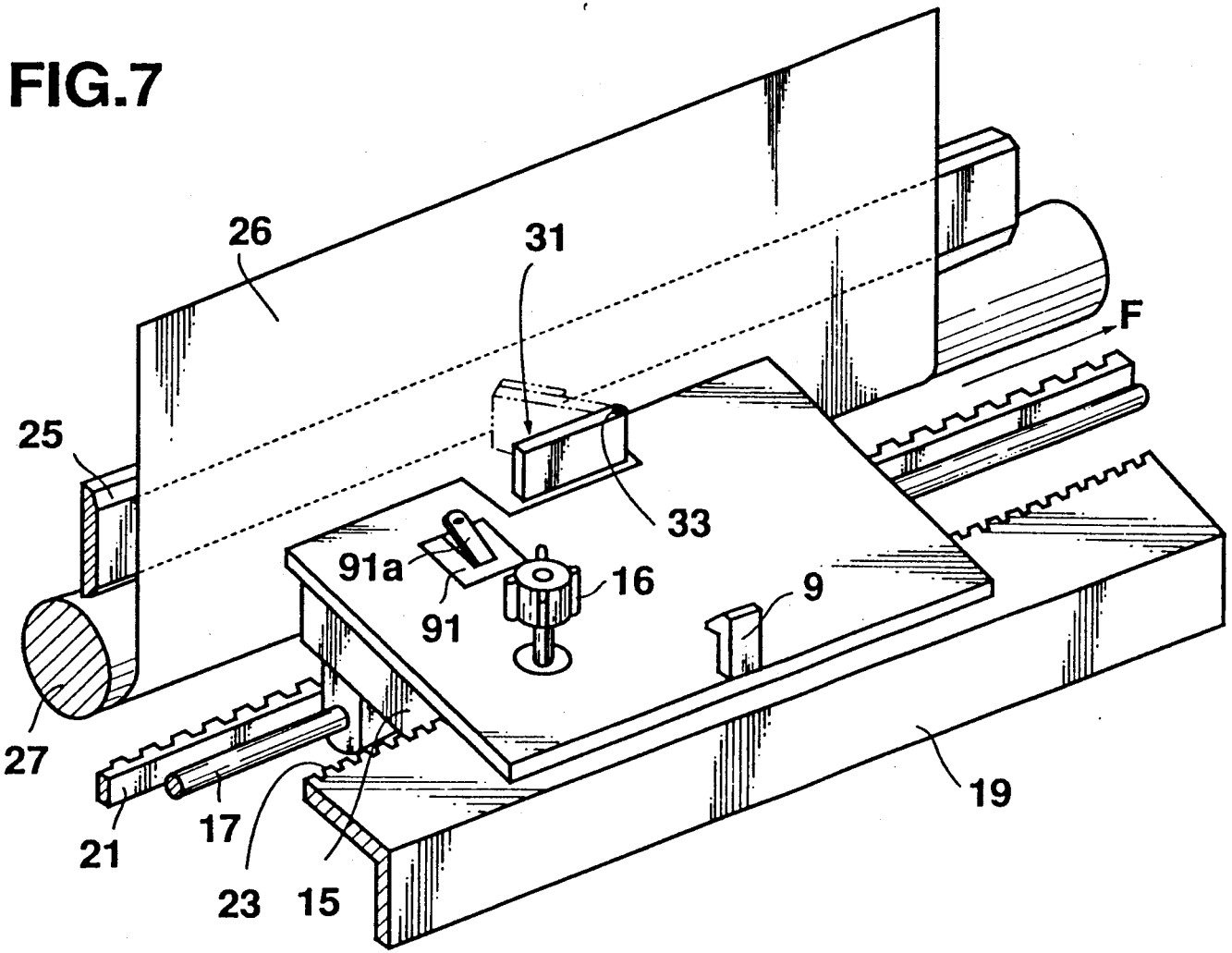
FIG. 7 is a perspective view mainly showing a carriage of the printer of FIG. 6.

In FIGS. 6 and 7, a contact element 91 faces a lower face of the exposed portion 81*b*. As shown in FIG. 7, the contact element 91 is fixed to the upper face of a carriage 15 and provided with a resilient contact piece 91*a* that obliquely extends upward from the contact element 91. The carriage 15 is provided with the printing head means 31 and incorporates a gear mechanism interlocking with a rack 23. During a recording motion in a direction F, the carriage 15 drives and rotates a winding cam 16 with which the reel 7 engages from the above.

The operation of the second embodiment will be explained.

Figure 8:
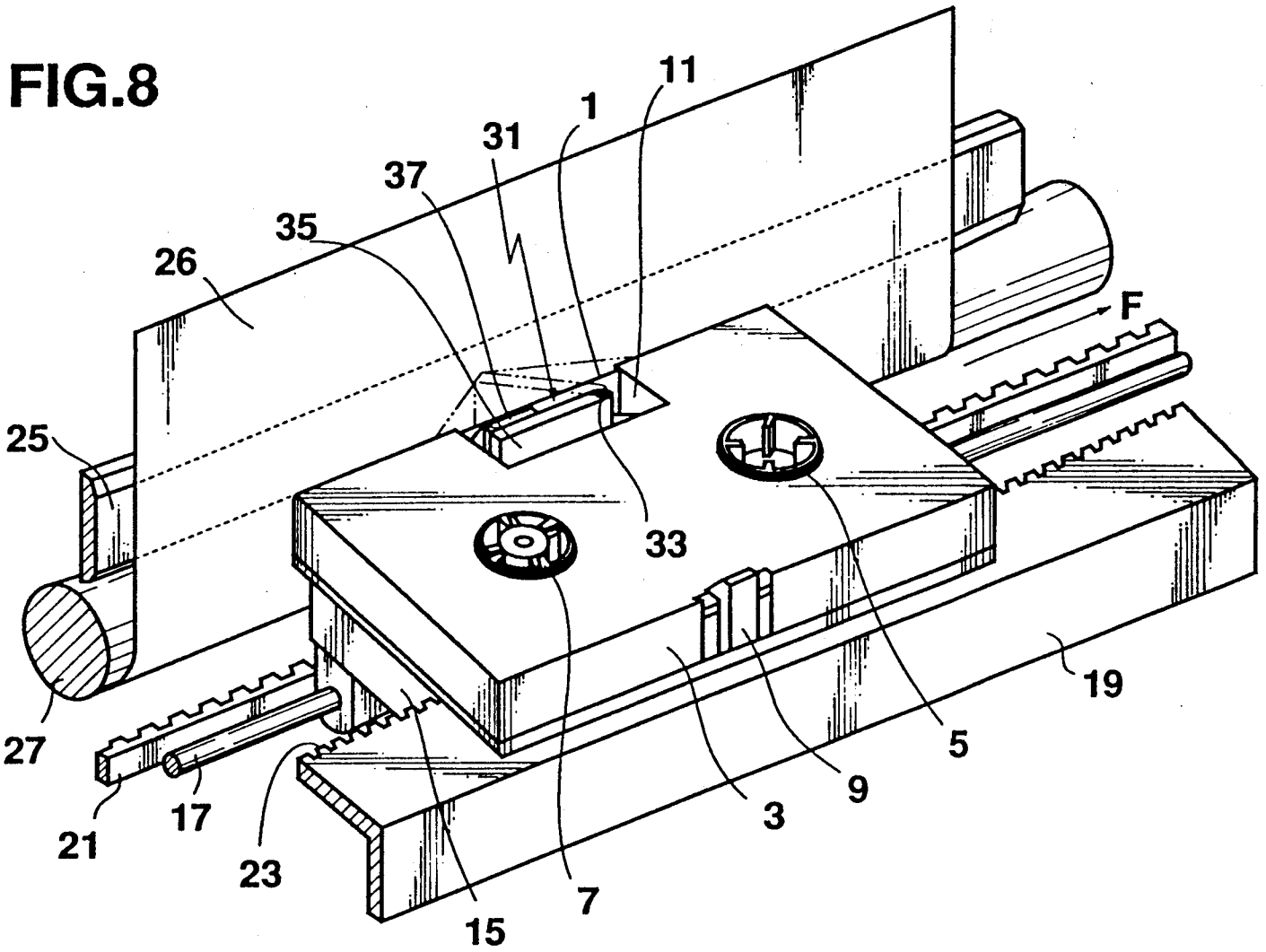
FIG. 8 is a perspective view showing the cartridge installed in a carriage.

In FIG. 7, the cartridge 3 is removed from the carriage 15, and the printing head means 31 is at a standby position indicated with a continuous line. When the cartridge 3 is installed to the carriage 15 from the above, the printing head means 31 is received as it is in the head receiving portion 11 as shown in FIG. 8. At the same time, the winding cam 16 is inserted into the reel 7, and the contact piece 91*a* of the contact element 91 resiliently contacts with the exposed portion 81*b* of the return electrode 81. This installed state is maintained by a hook 9.

The return electrode 81, cartridge 3 and ink ribbon 1 constitute a unit that is independent of the carriage 15. Therefore, by only placing the cartridge 3 on the carriage 15, the unit may be set in position. And by only releasing the hook 9, the unit may be removed from the carriage 15.

Once the cartridge 3 with return electrode 81 is set on the carriage 15, the printer may repeat recording and returning motions. During the recording motion, the printing head means 31 brings the ink ribbon 1 to an ink transferring position as indicated with an imaginary line of FIG. 8 to perform printing in a known manner.

At this time, a recording current flows from a recording electrode of the printing head 37 to the resistive layer and then to conductive layer of the ink ribbon 1. At the position of the return electrode 81, the recording current passes through the resistive layer again, electrode body 81, exposed portion 81*b* and contact element 91 and is discharged to the carriage 15.

The invention is not limited by this embodiment. For example, the exposed portion 81*b* may be omitted, and the electrode body 81*a* may be exposed from the lower face of the bottom plate 3*c* to contact with the contact element 91.

The second embodiment is provided with one return electrode 81 and one contact element 91. However, similar to the first embodiment, two sets of them may be arranged on left and right sides respectively. This will achieve the same electricity collecting effect as that of the first embodiment.

As explained in the above, according to this embodiment, a return electrode contacting with an ink ribbon is disposed inside a cartridge for accommodating the ink ribbon. Therefore, a mechanical interlocking portion of a carriage is eliminated to simplify a printer arrangement and reduce costs. The cartridge can quickly and easily be installed to and removed from the carriage.

Various modifications will become possible for those skilled in the art after receiving the teachings of the present disclosure without departing from the scope thereof.

What is claimed is:

1. A thermoelectric printer in which a printing head means having a recording electrode applies a recording voltage to a thermoelectric ink ribbon to supply a recording current to the ink ribbon, a part of the current supplied ink ribbon being heated, an ink being transferred from the part of the ink ribbon to a printing sheet to print a pattern on the printing sheet, and at least one return electrode being provided for discharging the current flowing from said recording electrode through the ink ribbon, the thermoelectric printer comprising:

(a) a cartridge accommodating the ink ribbon;

(b) a carriage for removably supporting said cartridge;

(c) the return electrode disposed inside said cartridge and containing the ink ribbon to discharge the current flowing from said recording electrode through the ink ribbon; and (d) conductive means arranged to contact said return electrode when said cartridge is installed to said carriage, for discharging the current from said return electrode to said carriage.

2. The thermoelectric printer as claimed in claim 1, wherein said conductive means comprises at least one conductive contact element disposed on said carriage such that, when said cartridge is installed on said carriage, the contact element protrudes inside said cartridge to electrically contact said return electrode.

3. The thermoelectric printer as claimed in claim 2, wherein said conductive means further comprises a conductive resilient member interposed between said return electrode and the contact element when said cartridge is installed on said carriage.

4. The thermoelectric printer as claimed in claim 2, wherein the printer is provided with two sets of said return electrodes and contact elements.

5. The thermoelectric printer as claimed in claim 1, wherein said return electrode has an exposed portion exposed outside said cartridge, and said conductive means comprises at least one conductive contact element disposed on said carriage to electrically contact with the exposed portion of said return electrode when said cartridge is installed on said carriage.

6. The thermoelectric printer as claimed in claim 5, wherein the printer is provided with two sets of said return electrodes and contact elements.

* * * * *